US006279168B1

(12) United States Patent
Bean

(10) Patent No.: US 6,279,168 B1
(45) Date of Patent: Aug. 28, 2001

(54) WRAPPING DEVICE AND METHODS

(75) Inventor: Travis A. Bean, Goleta, CA (US)

(73) Assignee: Adam M. Holms, Goleta, CA (US)

( * ) Notice: Subject to any disclaimer, the term of this patent is extended or adjusted under 35 U.S.C. 154(b) by 0 days.

(21) Appl. No.: 09/420,514

(22) Filed: Oct. 18, 1999

(51) Int. Cl.[7] ..... A42B 1/24

(52) U.S. Cl. ..... 2/209.13; 2/195.1; 40/317; 40/329

(58) Field of Search ..... 2/209.13, 181.4, 2/195.2, 181, 181.2, 195.1, 183, 195.3, 195.4, DIG. 11, 171, 171.4, 171.5, 171.7, 171.8; 40/329, 586, 317; 119/792, 856, 865; 150/154, 159, 161, 165

(56) References Cited

U.S. PATENT DOCUMENTS

| | | | | |
|---|---|---|---|---|
| 4,918,758 | | 4/1990 | Rendina . | |
| 5,003,640 | | 4/1991 | Pizzacar . | |
| 5,161,259 | | 11/1992 | Shorts . | |
| 5,287,559 | * | 2/1994 | Christiansen et al. | 2/181 |
| 5,315,714 | | 5/1994 | Peters et al. . | |
| 5,418,981 | | 5/1995 | Miner . | |
| 5,428,844 | * | 7/1995 | Dougherty | 2/209.13 |
| 5,517,695 | * | 5/1996 | Murray | 2/195.1 |
| 5,600,855 | * | 2/1997 | Ramirez | 2/209.13 |
| 5,687,425 | | 11/1997 | Blosser . | |
| 5,704,259 | * | 1/1998 | Riehle | 81/22 |
| 5,857,220 | * | 1/1999 | Erny et al. | 2/244 |
| 5,862,524 | | 1/1999 | Case . | |
| 5,918,316 | * | 7/1999 | Nathanson et al. | 2/209.13 |
| 5,950,242 | * | 9/1999 | Mahoney | 2/209.13 |

FOREIGN PATENT DOCUMENTS

| | | | | |
|---|---|---|---|---|
| WO 97/06672 | * | 2/1997 | (WO) | 119/792 |

* cited by examiner

*Primary Examiner*—John J. Calvert
*Assistant Examiner*—Katherine Moran
(74) *Attorney, Agent, or Firm*—Leo F. Costello

(57) ABSTRACT

A wrap for conditioning the interface between a part of an article and a user's body and a method of making and using the wrap. The wrap provides a flexible, resiliently compressible, elastic pad that is flexed into a tubular configuration for tightly wrapping around the part being wrapped so that the inside surface of the end segment at one end of the pad overlaps the outside surface of the end segment at the other end of the pad; an adjustable fastening strip interposed the overlapping ends that allows the pad to be wrapped about parts of various perimeters and provides stability at the interface being conditioned; and attaching members on the opposed surfaces of the pad and the fastening strip that releasably engage each other and tightly hold the pad in wrapped condition around the part being wrapped.

33 Claims, 4 Drawing Sheets

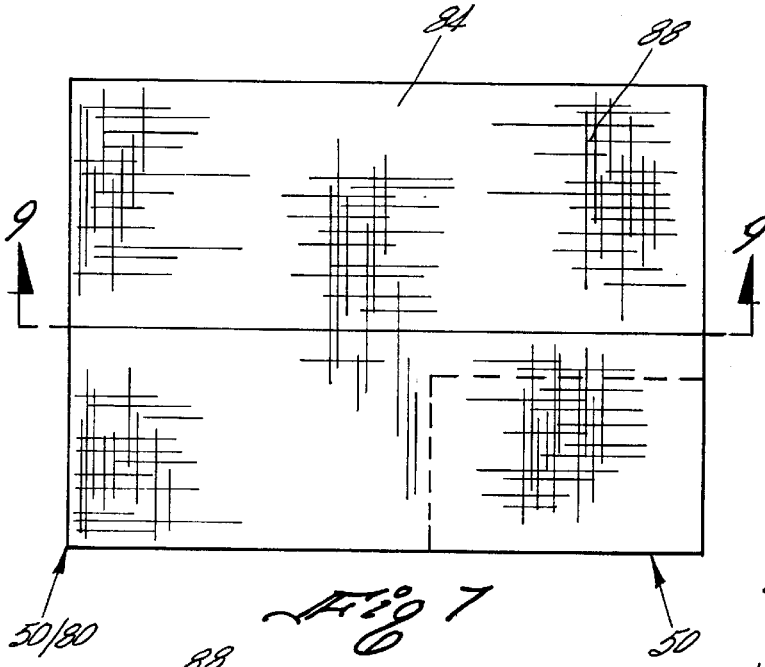
Fig 7
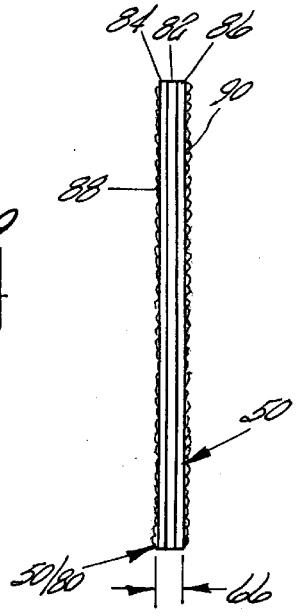
Fig 8
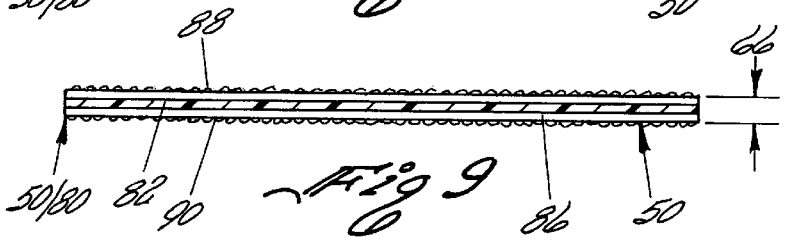
Fig 9
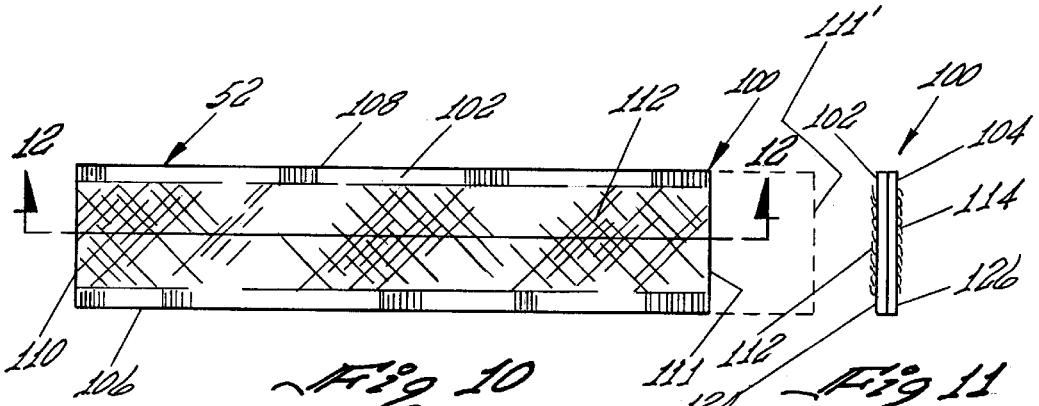
Fig 10
Fig 11
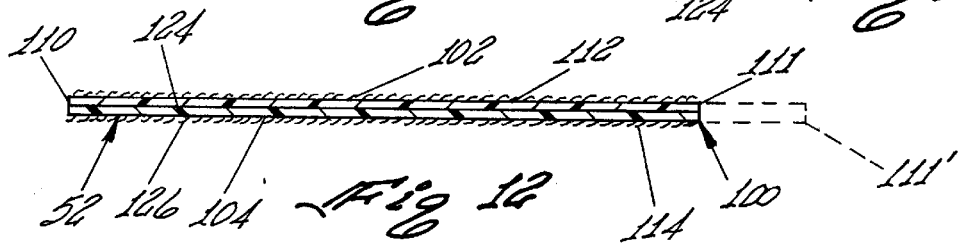
Fig 12

WRAPPING DEVICE AND METHODS

FIELD

The present invention pertains to a wrapping device and to methods of making and using the same and more particularly to a versatile device that can be wrapped around a portion of an article, such as a hat strap, to cushion and otherwise condition the interface between such portion and the part of a user's body that would normally contact such portion and to methods for making and using such a device.

BACKGROUND

Certain articles that come into engagement with a user's body during use sometimes present an interface between the article and the user that is less than desirable. Such articles include wearing apparel that have straps, belts, or buckles that contact the body; various items that have handles such as tools, appliances, exercise equipment, and luggage; animal collars; and the like. Problems usually occur because of the pressure of sharp or uncomfortable edges or surfaces on the article, the temperature of the article, the coefficient of friction at the interface, or the like. The appearance of the interface may also be a negative factor.

An example of such a problem is when a baseball-type cap is worn backward, as is standard practice for a baseball catcher but has become very popular for many people in everyday wear. When so worn, the adjustable strap at the back of most caps engages the wearer's forehead, and the hard surfaces and edges of the strap or the buckle press tightly against the wearer's head. This interface may be uncomfortable during wear, and the straps may leave an impression or an abrasion on the forehead after the cap is removed, either as a result of wearing the cap or in putting it on or taking it off. Moreover, some adjustable straps have intermitting pegs and holes that provide a rough surface from the outside of the cap and may be regarded as unsightly.

The problems of discomfort and appearance with the adjustable straps of baseball caps have been addressed in such patents as those to U.S. Pat. Nos. to Peters et al. 5,315,714; Blosser 5,687,425; Christiansen et al. 5,287,559; and Miner 5,418,981. The Peters and Blosser devices are manufactured as tubes in a size intended fit over the straps. These straps are of different widths but even if a tube is sized to the particular width of a baseball cap strap, it cannot be tightly wrapped or wound about the strap and thus may not be remain in a desired position, especially as the cap is put on and off many times. Moreover, such tubular devices intended solely for baseball-type caps do not have the ability to wrap parts of other articles where interface problems exist and where the part is not made with separable segments allowing a tube to slip over them. The Christiansen and Miner devices fold over the hat strap but do not wrap tightly about the strap nor do they have the versatility to wrap around parts of a multitude of other articles.

SUMMARY

A wrap for conditioning the interface between a part of various articles and a user's body is provided and includes a flexible, resiliently compressible, elastic pad that is flexed into a tubular configuration for tightly wrapping around the part being wrapped so that the inside surface of the end segment at one end of the pad overlaps the outside surface of the end segment at the other end of the pad; an adjustable fastening strip interposed the overlapping ends that allows the pad to be wrapped about parts of various perimeters and provides stability at the interface being conditioned; and attaching members on the opposed surfaces of the pad and the fastening strip that releasably engage each other and tightly hold the pad in wrapped condition around the part being wrapped. A method of making and using the wrap is also provided.

An object of the present invention is to provide a wrap for cushioning or otherwise conditioning the interface between a part of an article and a user's body against which the part of the article would normally press.

Another object is provide a wrapping device that is adjustable for wrapping tightly about parts of articles of differing perimeters.

A further object is to provide an elastic, resiliently compressible wrapping device that can be stretched to wrap tightly about a part of an article and that still retains enough body to cushion the interface between the part of the article and the part of the user's body.

A still further object is to provide a wrap that functions to identify the user or a particular organization or that displays a message or other indicia.

An additional object is to provide an article wrapping device having inside and outside surfaces that have desirable coefficients of friction for conditioning the interface with a user's body and that mount Velcro-type hook and loop fasteners and further having an outside surface capable of being imprinted.

Yet another object is to provide a wrapping device for cushioning the interface between an article and a user of the article and that incorporates an adjustable fastener that allows the device to be wrapped tightly about a part being wrapped and that also serves to impart stability and additional body to such interface.

A further object is to provide a wrap that is versatile enough to wrap around the parts of many articles, such as the strap of a hat, the handle of a tool, the grip of a barbell, the handle of luggage, an animal collar, and many other articles.

More specific objects are to cushion the interface between the hat strap of a baseball-type cap and the wearer's forehead when the cap is worn backward; to cushion and enhance the grip of a user's hand on the handle of a tool, a barbell, or a handle of a piece of luggage; to alleviate the discomfort of a collar on an animal; to identify an owner of an article or animal; or to similarly condition a user/article interface and/or identify various other articles or animals.

Yet another object is to provide a method of making a wrap in various sizes and shapes.

A still further object is to provide a method that allows a user to acquire materials from which the elements of wraps of various sizes and shapes can be cut to enable wrapping and/or identifying various articles as the need arises.

These and other objects, features and advantages of the present invention will become apparent upon reference to the following description, accompanying drawings, and appended claims.

DESCRIPTION OF THE DRAWINGS

FIG. 7 is a plan view of either the pad of the wrapping device shown in FIGS. 5 and 6 or of a sheet of material from which pads like that shown in FIGS. 5 and 6 may be cut.

FIG. 8 is an edge view of the sheet or pad shown in FIG. 7.

FIG. 9 is a section taken on line 9—9 in FIG. 7.

FIG. 10 is a plan view of the fastening strip of FIGS. 5 and 6 and also indicates by the dashed lines at the right that the strip may be cut from a longer length or strip of material from which one or more fastening strips maybe cut.

FIG. 11 is an end edge view of the strip or length of material shown in FIG. 10.

FIG. 12 is a side edge view of the fastening strip or length of material shown in Fig. 10.

DETAILED DESCRIPTION

Figure 1:
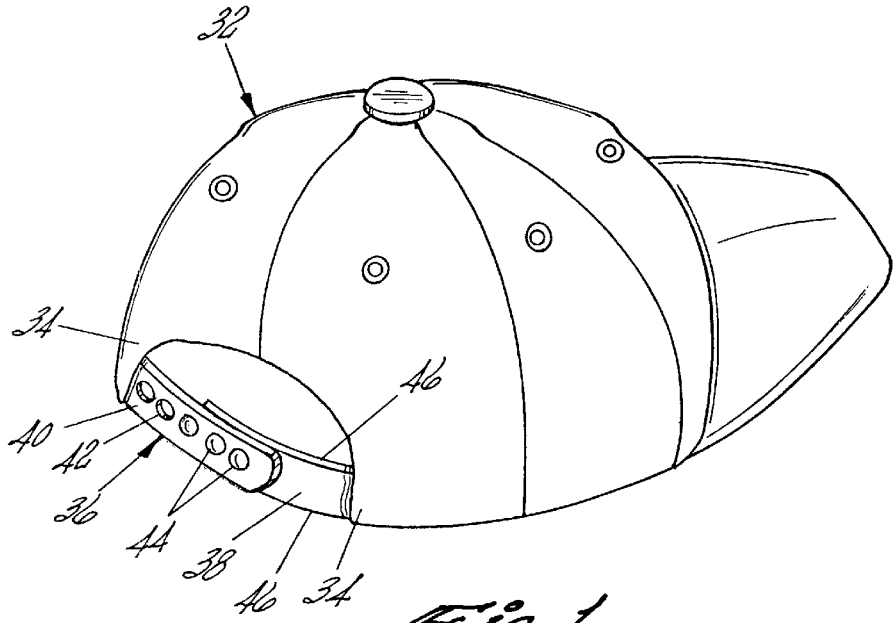
FIG. 1 is an isometric view of a baseball-type cap as seen in looking at the rearward portion of the cap but without the wrapping device of the present invention applied to the cap.

A wrapping device is generally indicated by the numeral 30 in the drawings (FIGS. 2, 3, 4, 13–18) and may be referred to as a strap wrap in its application to various articles of manufacture having straps. One of these is a baseball-type cap, as 32 (FIGS. 1–4), having spaced rear portions 34 that provide a gap at the rear of the cap. As is well known, the cap may be provided with an adjustable strap or part 36 including overlapping inner and outer segments 38 and 40, one of which has a series of spaced holes 42 and the other of which has a plurality of spaced pegs 44 intended to be releasably press-fit into the holes.

The adjustable strap, as 36, on commonly available caps, as 32, usually has a width of about ¾ inch, a length of which varies from three inches long for the smallest head size to a length of about five inches long for the largest head size, and a thickness of about 1/16 inch when the two segments of the strap are overlaid. As is well known, the type of adjustable strap shown in FIGS. 1–4 and briefly described above is typically made of a durable, hard plastic material that has some flexibility but is generally stiff. As a result, the edges 46 of the strap segments can be relatively sharp.

Although not shown, baseball-type caps may also be provided with a strap having a buckle for adjustment. These straps may have different degrees of softness or hardness and may still present edges that leave impressions on the forehead of the wearer. Moreover, although the buckle on such a strap is usually adjacent to one of the rear portions, as 34, of the cap, it may still have hardware elements that face inwardly of the cap. If the cap is worn backward, these hardware elements can press against the forehead of the wearer and be uncomfortable and leave impressions on the forehead.

The wrapping device 30 of the present invention (FIGS. 1–12) includes a relatively thin. laminated, flexible, resiliently compressible and elastic wrapping pad 50, best shown by itself in FIGS. 7, 8 and 9. The wrapping device also includes a fastening strip 52 best seen by itself in FIGS. 10, 11 and 12. The fastening strip is also relatively thin and has a measure of flexibility but is relatively stiff as compared to the wrapping pad. Moreover, the fastening strip is essentially non-compressible and non-elastic. More detailed descriptions of the wrapping pad and fastening strip are provided below.

The wrapping pad 50 (FIGS. 5 and 6) is preferably rectangular for most applications but is not limited to this shape. In its preferred form as illustrated, it has an inside surface 56, and outside surface 58, longitudinal edges 60 and 62, and transverse edges 64 and 65. Also, the wrapping pad has a thickness dimension represented by the numeral 66, a length dimension 68 and a width dimension 70. The wrapping pad may be made in various dimensions, and in fact, one of the advantages of the subject wrapping device is its ability to wrap around parts of articles of various perimeters. Nevertheless, it may be informative to provide desirable dimensions for the wrapping pad used as a strap wrap for a baseball-type cap, although the invention is not limited to any particular dimensions. Thus, assuming that the wrapping pad is rectangular and is in its relaxed or non-stretched or non-compressed condition, it has a thickness dimension 66 of about ⅛ inch, a length dimension 68 which varies from about 2¾ inches for the smallest size hat or the adjustable strap 36 as described above to a maximum length of about five inches for the largest hat size, and a width dimension 70 of about 2 inches for a hat strap having a width of about ¾ inch. These dimensions provide a snug fit of the wrapping pad about the typical adjustable strap of a baseball-type cap, but such dimensions may be adjusted to the suit the particular user's preferences, either as initially cut from a sheet of pad material or with the adjustment feature of the present invention, both of which are described below. Note that the edges designated as the "length" and the "width" are arbitrarily assigned inasmuch as the edge 70 could be longer than the edge 68, depending on the perimeter of the part to be wrapped, or they could be of equal lengths if the pad were square.

Figure 4:
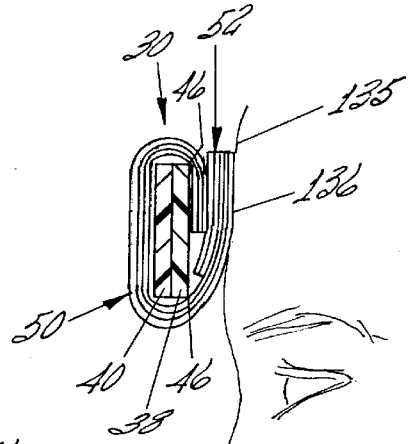
FIG. 4 is a view similar to FIG. 3 but showing the condition of the wrapping device when the cap is being worn on a wearer's head a portion of which is illustrated.
Figure 5:
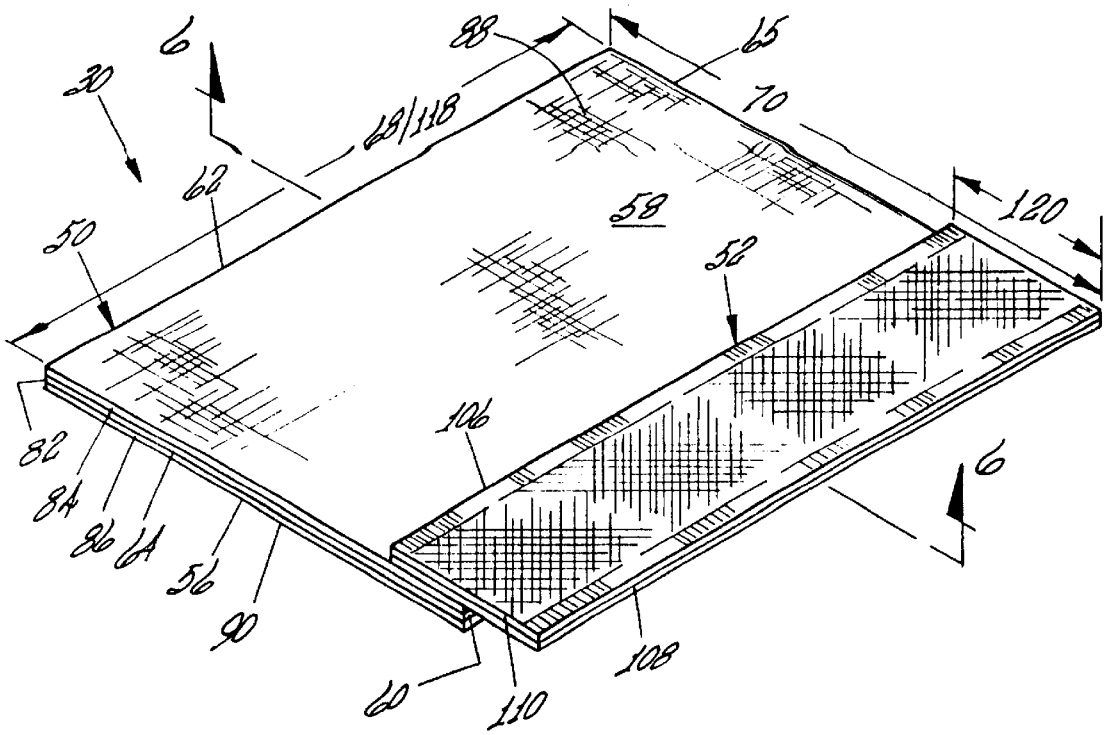
FIG. 5 is an enlarged isometric view of the wrapping device in its unfolded, generally flat condition with the fastening strip of the device shown in one of its adjustable positions on the pad of the device.

Thus, the wrapping pad or pads 50 (FIGS. 2–9) may be cut by a user from a purchased sheet 80 (FIG. 7) of pad material or may be made and sold as an individual pad (FIG. 5). Reference is now made to FIGS. 7, 8 and 9 to describe the components of the pad as well as the method of its manufacture. FIGS. 7, 8 and 9 serve a dual purpose. Considered on a smaller scale, the views in FIGS. 7, 8 and 9 show a sheet 80 of pad material from which smaller pads 50 may be cut with common scissors. One of these pads is shown in dashed lines at the lower right hand corner of the sheet in FIG. 7. Viewed on a larger scale, the views in FIGS. 7, 8 and 9 are of the entire pad by itself, in which case the dashed lines in the lower right corner of FIGS. 7 would not exist.

Considering FIGS. 7, 8 and 9 as a sheet 80 of pad material, the sheet is composed of an intermediate layer 82 of resiliently compressible, elastic sheet material. Various natural or synthetic rubber or rubber-like materials may be used for this purpose. A preferred material for the intermediate layer is manufactured and sold under the trademark R-1490-N Comfortex® by the Rubatex Corporation of Bedford, Va. This Comfortex® material is a blend of neoprene/butyl and has durability, thermal characteristics, a relatively low modulus of elasticity or stretchability, flexibility and draping characteristics, and feels almost like gel to the touch. It has a thickness of about 1.5 millimeters or 1/16 inch.

The sheet 80, or pad 50 (FIGS. 7–9), also includes first and second, outer, looped fabric layers 84 and 86, each of which is flexible but being of fabric material is not inherently elastic or possessive of resilient compressibility. Thus, the first and second outer layers have outwardly projecting Velcro®-type loops 88 and 90. The outer layers are adhesively bonded on opposite sides of the intermediate layer 82 so that the intermediate layer is sandwiched between the outer layers, as best seen FIGS. 8 and 9. The combination is still elastic but not to the degree of the intermediate layer by itself. The combination of course still has resiliently compressibility. Preferably, the first and second outer layers 84 and 86 are respectively the "Unbroken Loop 44 inch Wide 200 Series" and "Plush Nylon 44 inch Wide Series 500," as manufactured and sold by the Rubatex Corporation. The reasons for preferring these particular fabrics will be subsequently described. Preferably, the entire sheet 80 or pad 50 is a product manufactured and sold by the Rubatex Corporation having their components as described above.

In general, therefore, the sheet 80 of pad material (FIGS. 7–9) and of course each individual wrapping pad 50 are laminated with an intermediate, resiliently compressible elastic layer 82 and outer fabric layers 84 and 86 having outwardly disposed Velcro®-type loops 88 and 90. The general characteristics of these layers are described above with reference to the Rubatex products. It is to be understood, that the invention is not limited to this particular laminated product but the sheet or pad may be assembled from components having similar characteristics from various other sources. Although the intermediate layer is durable, resiliently compressible and elastic, the outer fabric layers do not have these qualities, as indicated above. When the outer layers are bonded to the intermediate layer, however, they reduce the degree of elasticity of the wrapping pad while retaining essentially all of the resilient compressibility of the intermediate layer. The pad retains sufficient elasticity to wrap and tightly fit around the strap 36 or other parts of articles being wrapped.

Various advantages of using the resiliently compressible, elastic intermediate layer 82 of the preferred material, especially the preferred material described above, laminated on both sides with the looped layers 84 and 86 may be summarized as follows. The pad can be stretched or flexed in a manner that best suits whatever application is involved. Moreover, the pad has the desired degree of elasticity in order to assure the tightest and snuggest fit to maintain the display panel 138 showing at all times. In addition, this elasticity allows the fastening strip 52 to be entirely covered and concealed when the pad is stretched over it as will be subsequently described.

FIG. 10 serves a dual illustrating function for the fastening strip 52 like FIG. 7 does for the pad 50. That is, by the dashed lines at the right of FIG. 10, this figure may be viewed as showing a length 100 of strip material from which multiple fastening strips may be cut. Individual fastening strips of desired length may be cut with common scissors to fit corresponding wrapping pads 50. Alternatively, FIG. 10 may be viewed as a single, individual fastening strip 52. The fastening strip 52 or length of strip material 100 has opposite first and second hooked surfaces 102 and 104, opposite longitudinal edges 106 and 108, and end edges 110 and 111,111'. The end edge 111 in solid lines at the right is for an individual fastening strip and the end edge 111' represents wherever the end is for a long length 100 of the strip. The books 112 and 114 on the first and second surfaces are outwardly directed and are of the Velcro®-type that are capable of releasably attaching to the Velcro®-type loops 88 and 90 on the outer layers 84 and 86 of the wrapping pad 50.

Figure 6:
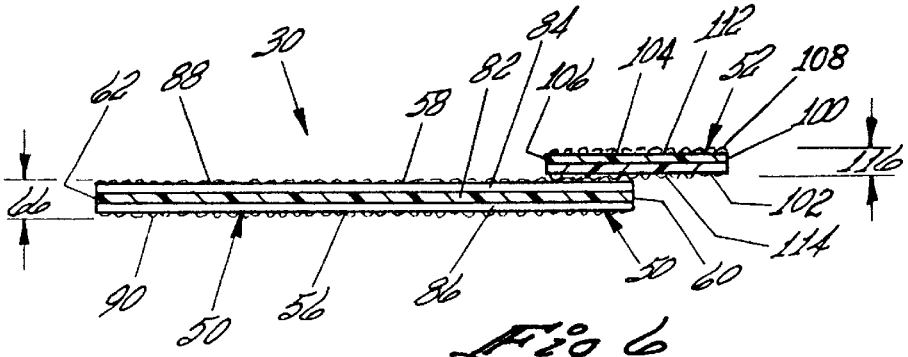
FIG. 6 is an edge view of the wrapping device as seen in FIG. 5.

The thickness of the fastening strip 52 or the length of strip material 100 is generally indicated by the numeral 116 in FIG. 6. Also, the length 118 and width 120 of an individual fastening strip are indicated in FIG. 5. The length 118 of the individual fastening strip is essentially the same as the length 68 of the wrapping pad 50. The longitudinal dimension of the length of strip material 100 may be as long as desired, for example, thirty-six inches long, so as to provide enough material to enable several shorter strips to be cut from the length.

In the example of the wrapping device 34 for a typical baseball-type cap 32, the preferred length of the fastening strip 52 will vary from about 2¾ inches to about 5 inches. The width 120 of the fastening strip 52, however, is considerably less than the width 70 of the wrapping pad 50. Although the width of the wrapping pad will vary depending on the perimeter of the part, such as the strap 36, to be wrapped, the width of the fastening strip may be relatively standard or common to various widths 70 of wrapping pads. In the preferred embodiment for a typical baseball-type cap, the width of the fastening strip is about 21/32 inch. Again, the invention is not limited to this particular dimension which is given only as an example for the application under discussion.

With reference to FIGS. 10, 11 and 12, it should be noted that the fastening strip 52 or the length 100 of strip material may be composed of two back-to-back lengths 124 and 126 of strip material each of which have the hooks 112 and 114 on one of their surfaces. These two strips 124 and 126 are adhesively bonded in back-to-back relation, as seen in FIGS. 11 and 12, thereby to form the double-hook sided fastening strip or length of material. The double-sided strip 52 or length 100 may be thusly made by acquiring single-sided hook material and bonding two lengths of this material in back-to-back relation. For example, the single-sided material may be that sold by the Perfectex Plus LLC of 5351 Oceanus Drive of Huntington beach, Calif. 92649 as their ⅝" Black Hook P/Sensitive material. A length of this material may be cut in equal lengths and the two lengths bonded together. In other words the Perfectex material has the hooks on one side and has an adhesive on the opposite side. The double-sided fastening strip 52 of such Perfectex material has the desired a measure of stiffness giving it more body than the wrapping pad 50, thereby imparting body and stability to the wrapping device 32 in use.

The fastening strip 52 and pad 50 are assembled by laying the strip along the edge 60 (FIGS. 5 and 6) of the pad. The exact position of the strip depends on the size, i.e., perimeter of the part to be wrapped. The double-sided hook fastening strip 52 can be easily moved between the edges 60, 62, i.e., transversely of the pad, to allow for adjustments in the tension of the wrapping device 30. The fastening strip can also be moved from the longitudinal edges 60 or 62 to the transverse edges 64 or 65 where it can be adjusted lengthwise of the pad thereby allowing greater ability to fit a wider range of sizes of parts, such as the strap 36, to be wrapped.

Operation and Method of Making and Using

Preferred ways of making the wrapping pad 50 and fastening strip 52 of the subject wrapping device 30 have been described above with particular reference to FIGS. 7–12. Assuming that it is desired to provide a strap wrap 30 for wrapping the adjustable strap 36 of a baseball-type cap 32, a wrapping pad 50 is cut from the sheet 80 in the desired size, such as is suggested above. Furthermore, a fastening strip 52 is cut from the length 100 of the strip material, again in a size commensurate with the wrapping pad and with the size of the adjustable strap 36 to be wrapped. Preferred dimensions of both the pad and the strip are given above for the strap wrap application.

With reference to FIGS. 5 and 6, the fastening strip 52 is positioned along and in alignment with a longitudinal edge 60 of the wrapping pad 30 with the fastening hooks 114 on the strip 52 attaching to the fastening loops 88 on the pad. The exact position of the fastening strip relative to the wrapping pad will depend on the circumference or perimeter of the strap 36 being wrapped. Adjustment of the position of the fastening strip is thus one of the features of the present invention to allow the wrapping device to accommodate different perimeters of parts being wrapped.

Figure 3:
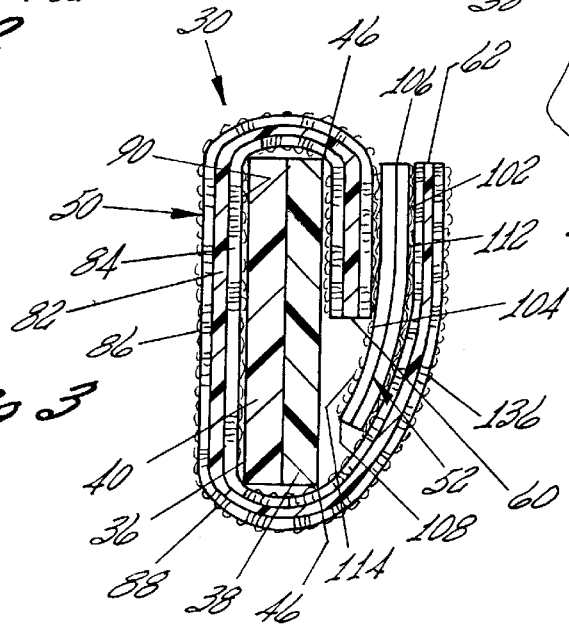
FIG. 3 is an enlarged transverse section taken on line 3—3 in FIG. 2 and showing the wrapping device as it would look when the cap is not being worn.

The inside surface 56 (FIG. 3) of the pad 50 is then placed against the outer segment 40 of the attached segments 38 and 40 of the hat strap 36 over the pegs 44 and holes 42 and with the fastening strip 52 disposed upwardly and facing outwardly of the cap. The fastening strip and the upwardly disposed end of the wrapping pad are then folded inwardly over the strap and downwardly into opposed relation to the inner segment 38 of the strap, with the inside surface 56 engaging the inner segment 38 and the fastening strip extending downwardly opposite to and perhaps partially engaging the inner segment, as shown in FIG. 3. Next, the downwardly disposed end of the wrapping pad is folded under the strap and stretched upwardly into overlaying relation with the fastening strip. In other words, the inside surface 56 of the initially downwardly disposed end portion of the wrapping pad is brought into the cap and pulled upwardly into overlaying relation with the first hooked surface 102 so that the hooks 112 of this surface attach to the loops 90 on the inside surface 56 of the wrapping pad and tightly hold the wrapping device about the strap 36. As best seen in FIG. 3, the fastening strip is positioned opposite to and partially against the inner segment of the strap so that the width 120 of the fastening strip is essentially coterminous with the width of the adjustable strap 36. Moreover, when the lower end portion of the wrapping pad is brought around into overlying relationship with the fastening strip, the longitudinal edge 62 of the pad is brought into alignment with longitudinal edge 106 of the fastening strip. With a properly sized wrapping device, these two edges 62 and 106 will then be located adjacent to the upper edge of the adjustable strap, such as shown in FIG. 3. Moreover, the fastening strip will be essentially concealed by the folded over and wrapped pad 50. It is to be noted that although the particular application illustrated in FIGS. 3 and 4 do not show the fastening strip to be in contact with the inner segment 38 of the strap, in many applications such contact does occur, particularly when the cap is worn.

Figure 2:
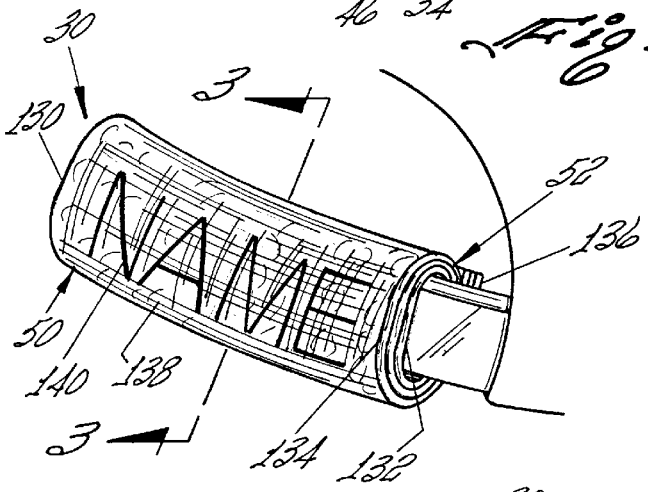
FIG. 2 is an enlarged fragmentary view of the cap of FIG. 1 showing the wrapping device of the present invention wrapped around the adjustable straps at the rear of the cap.

As above described, therefore, the wrapping device 30 is folded from its generally flat condition as shown in FIGS. 5 and 6 into a tube 130 as seen in FIGS. 2–4. This tube thus provides an axial opening 132 which receives the part, that is the strap 36 here, being wrapped. The tube thus provides a front portion 134 and a rear portion 136. The front portion provides a display panel 138 on which may be provided indicia 140, such as the name of a sports team, the wearer's name, a logo, slogan, or the like. In this regard, the outer layer 86 with its loops 88 is optimally selected to accept silk-screening, or other forms of imprinting, or embroidering, so as to create the indicia 140. The product identified above as "Unbroken Loop 44 inch Wide 200 Series" from Rubatex has been found to be very suitable for this purpose.

In the strap wrap 30 for a baseball-type cap 32 (FIG. 4), the rear portion 136 includes the fastening strip 52 sandwiched between the overlapping end portions of the pad 50. It is this rear portion, and specifically the outer layer 86, that engages the forehead 135 of the wearer as generally indicated in FIG. 4. Not only does a material such as "Unbroken Loop 44 inch Wide 200 Series" look better and take silk-screening for the display panel 138, it feels better and is more wear-resistant. As contrasted with the layer 86, the layer 84 may be of less expensive material since need not be suitable for printing nor does it contact the user's skin.

With reference to FIGS. 3 and 4, then, FIG. 3 shows the strap wrap 30 as it is positioned about an adjustable strap 36 of a baseball-type cap 32 when the cap is not being worn. The overlapping ends of wrapping pad 50 and fastening strip 52 at the rear portion 136 of the wrapping device is in a somewhat expanded condition as compared to when the cap is worn. This expanded condition is of course the essentially uncompressed condition of the rear portion of the intermediate resiliently compressible layer 82 although some minor compression may occur as the pad is stretched about the strap. When the cap is worn, the user's forehead 135 presses inwardly on the rear portion 136 of the strap wrap causing the rear portion to be compressed between user's forehead and the adjustable strap 36. The fastening strip not only enables adjustable attachment of the opposite ends of the wrapping pad, but it also provides body and stability to the rear portion of the strap wrap thereby to distribute more evenly the compressive forces between the adjustable strap and the user's forehead, adding comfort to the user.

Various advantages of the strap wrap 30 and its positioning on the adjustable strap 36 are to be noted. Because the end edges 62 and 60 are disposed adjacent to the upper edge of the strap 36, these edges do not interfere with putting the cap on or taking it off. Moreover, because of the elasticity of the wrapping pad and tenacity of the Velcro®-type loops and hooks, the device is very tightly wrapped and fitted around the strap so that it does not move when the cap is being put on or taken off nor when the cap is being worn. This not only lends to the comfort of wearer when using the wrap 30, but it also maintains the display panel 138 in proper position. Moreover, for the hat wrap described above as well as the other applications described below, the wrap is wear-resistant, provides thermal protection, can be stretched or flexed to suit various applications, can be used in aquatic environments while remaining totally functional, and is non-allergenic for most people.

Figure 13:
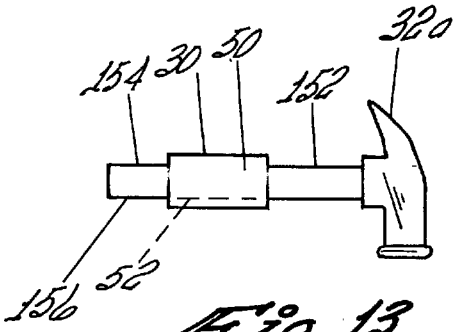
FIGS. 13, 14. 15, 16 and 17 are views of articles of manufacture to which the wrapping device of the present invention is applied.

One of the most significant advantages of the wrap 30 of the present invention is its versatility. Although it may be used as a strap wrap for wrapping the adjustable strap 36 of a baseball-type cap 32, as described above, it has many other wrapping uses some of which are shown in FIGS. 13–17. In FIG. 13, for example, the wrapping device 30 is wrapped about the handle 152 of a hammer 32*a*. In this application, the fastening strip 52 is placed under the lower portion 156 of the handle so as to enhance gripping of the handle.

Figure 14:
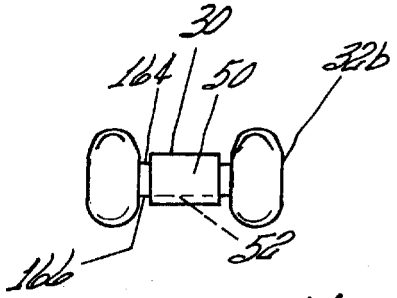

A dumb bell 32*b* is shown in FIG. 14 having a handle 162 providing upper and lower portions 164 and 166. As is well known.,the handles of such dumb bells are frequently grooved or knurled and may be uncomfortable to grip. Thus, the subject wrapping device 30 is wrapped around the handle with the rear portion 136 of the wrap including the fastening strip 52 under the lower portion 166 to provide a comfortable and firm grip.

Figure 15:
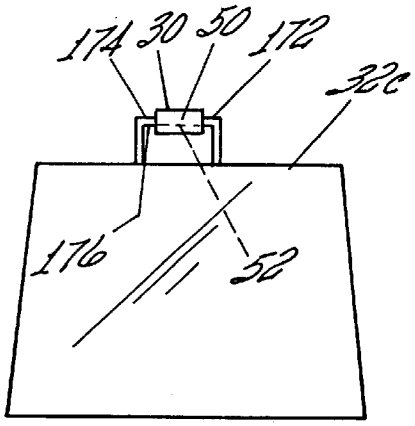

A briefcase, suitcase, or other luggage 32*c* is shown in FIG. 15. Again, the handle 172 of such a briefcase, particularly large briefcases as are often carried by airline captains, may have projecting ridges on their lower surfaces 166 which can press uncomfortably into a user's fingers if the briefcase is very heavy. Accordingly, the subject wrapping device 30 is wrapped around the handle with the rear portion 136 under the lower portion 176 whereby the wrap covers the ridges and render the grip comfortable, it being noted that the fastening strip along with the overlapping ends of the multi-layer cushioning pad serve to isolate the ridges from the fingers.

Figure 16:
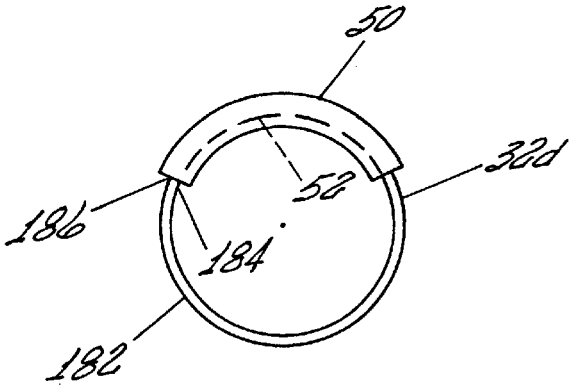

An animal collar 32*d* is shown in FIG. 16 as an example of another application of the subject wrapping device 30. Here, the device is wrapped around the strap 182 of the collar with fastening strip 52 inside of the inner surface 184 of the collar. Because of the resilient compressibility of the subject wrapping device, if the animal is on a leash and pulls with considerable force against the leash, the wrapping device will cushion the pressure on the animal's throat.

Figure 17:
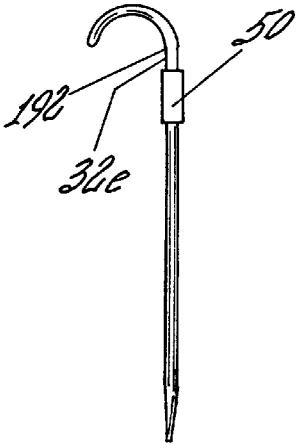

A slightly different application is shown in FIG. 17 which illustrates a ski pole 32*e*. Here, wrapping device 30 is wrapped around the handle part 192 of the pole. The purpose here is not to cushion engagement of the users hand with the ski pole but to provide a convenient method of identifying the pole by virtue of the logo and name on the display panel 138.

From the foregoing, it will be apparent that the subject wrapping device 30 is a comfort accessory to wrap around the adjustable strap of a hat, as 32, and provide a display logo, slogan, name, advertisement, design, or other indicia 140. Other applications of the subject wrapping device include backpack straps wherein the wrapping device can display slogans while providing abrasion protection; a construction hat strap for providing comfort from inside of the hat; a bicycle helmet strap that provides a place for a slogan as well as adding comfort to the helmet strap; a visor type hat strap; a wrapping for a lighter; a purse strap; a wrap for a chin guard providing comfort from elastic straps; a beverage can wrap; appliance handles thereby providing comfort and temperature protection (e.g. pots and frying pans) as well as having the user's favorite slogan; a baseball wrap; a pencil or pen wrap; a belt wrapping that displays a popular slogan in the back; a strap for a skin diving mask that not only provides comfort but also may be customized with the user's favorite logo or legend, and the like; a wrap for a motorcycle helmet strap; a toilet seat wrap; a hockey helmet strap that again provides not only comfort but also identification as well as a place for an advertisement. Of course, as illustrated in FIGS. 13–17, the wrap has application to tool handles, barbells or dumbbells, the handles of luggage including briefcases and suitcases; animal collars; and ski poles. In each of these instances, the wrapping device not only adds comfort but provides a place for the user's name, logo, legend, or the like.

Figure 18:
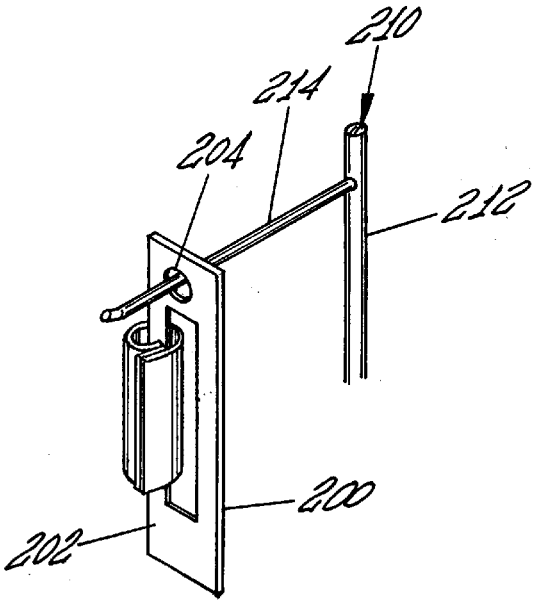
FIG. 18 is a fragmentary isometric view of one of the wrapping devices of the present invention attached to a hanger which in turn is supported on a display rack as a way of displaying the subject wrapping devices for sale.

FIG. 18 illustrates one of the ways of displaying a subject wrapping device 30 at the point of sale. A display rack 210 is shown including a post 212 having a projecting hanger rod 214. A frame type hanger 200 has an aperture 204 that slips over the rod, and the subject wrapping device 30 is wrapped around one of the legs of the hanger. The wrapping device is wrapped around the leg 202 of the hanger in the same manner as described above with regard to wrapping it about the adjustable strap 36 of a baseball type cap 32. The purchaser can merely remove the end of the wrapping pad 50 from the fastening strip 52 and then wrap it around the strap of the baseball cap. The display shown here would be for selling precut wrapping devices 30 intended primarily for wrapping the straps of baseball-type caps. For more general use, the parts of the wrapping device may be sold separately as a sheet 80 of pad material and a length 100 of fastening material so that the user may cut off a wrapping pad and a fastening strip to suit the particular application.

Although preferred embodiments of the present invention have been shown and described, various modifications, substitutions and equivalents may exist without departing from the spirit and scope of the invention. Accordingly, it is to be understood that the present invention has been described by way of illustration and not limitation.

What is claimed is:

1. A wrap for wrapping a part of an article, comprising:

a flexible pad having opposite inside and outside surfaces, opposite edges, a thickness dimension measured between said surfaces, and surface dimensions measured across the surfaces of the pad and between its edges, the pad having resilient compressibility in its thickness dimension and elasticity in its surface dimensions, the outside surface being comfortable to the user when in contact with the user's body, the pad being flexed into a tubular configuration thereby providing an axial opening for receiving the part being wrapped and being stretched along one of its surface dimensions so as to wrap around the part being wrapped, the inside surface of the pad overlaying and releasably attached to the outside surface of the pad.

2. The wrap of claim 1, wherein said surface dimensions define a predetermined area of the pad, wherein the wrap includes a fastening strip having first and second surfaces, opposite edges, a thickness dimension measured between its surfaces, and surface dimensions measured across the surfaces of the strip, the surface dimensions of the strip defining a predetermined area of the strip that is less that the predetermined area of the pad, wherein the fastening strip is positioned along an edge of the pad with the first surface of the strip overlaying and attached by a first attachment to the outside surface of the pad and with the inside surface of the pad overlaying and attached by a second attachment to the outside surface of the strip, and wherein one of said attachments is releasable.

3. The wrap of claim 2, wherein said one attachment includes hook and loop fasteners.

4. The wrap of claim 3, wherein there is an outer layer of either a hook-type fastener or a loop-type fastener on the surface of the pad where said one attachment is located, wherein there is an outer layer of the other of a hook-type fastener or a loop-type fastener on the surface of the strip where said one attachment is located, and wherein the overlying portions of the pad and strip are releasably attached by the interengagement of the hook-type and loop-type fasteners.

5. The wrap of claim 2, wherein the pad flexed into said tubular configuration provides front and rear portions, wherein the fastening strip is at the rear portion of the pad, wherein the outside surface of the pad at the front portion thereof provides an outwardly facing display panel, and wherein there is indicia on the display panel.

6. A wrap for conditioning the interface between a part of an article and a user's body, comprising:

a flexible, resiliently compressible, elastic pad having opposite end segments and inside and outside surfaces and being flexed into a tubular configuration for tightly wrapping around the part being wrapped, the inside surface of the end segment at one end of the pad overlapping the outside surface of the end segment at the other end of the pad;

a fastening strip interposed the overlapping end segments of the pad, the strip having opposite surfaces respectively facing the inside and outside surfaces of the pad; and attaching members on the overlapping and facing surfaces of the pad and the fastening strip that attach to each other, the strip being releasably attached to one of the end segments.

7. A wrapping device for wrapping a part of an article that normally comes in contact with a part of the body of the user of the article so as to enhance the comfort of the user's body relative to the article, comprising a rectangular flexible pad having opposite first and second surfaces, opposite longitudinal edges, opposite transverse edges, a thickness dimension measured between said surfaces, and length and width surface dimensions measured across the surfaces of the pad and between its edges, the pad having resilient compressibility in its thickness dimension and elasticity in its surface dimensions, the second surface being comfortable to the user when in contact with the user's body, and a rectangular fastening strip that is flexible but stiffer than the pad, the strip having first and second surfaces, opposite edges, a thickness dimension measured between said surfaces, and length and width dimensions measured across the surfaces of the strip, the length of the strip being about the same as the length of the pad and the width of the strip being less than the width of the pad, the strip having no appreciable resilient compressibility in its thickness dimension nor any elasticity in its surface dimensions, the fastening strip being positioned along a longitudinal edge of the pad with the second surface of the strip overlying and attached to the first surface of the pad, the pad being flexed into a tubular configuration thereby providing an axial opening for receiving the part being wrapped and being stretched along one of its surface dimensions so as to wrap around the part being wrapped, the second surface of the pad overlaying and releasably attached to the first surface of the strip.

8. The device of claim 7, wherein the pad flexed into said tubular configuration forms a tube having a width generally equal to the width of the strip, and wherein the fastening strip is within the tube and extends substantially throughout substantially the full width and length of the tube.

9. The device of claim 7, wherein the pad is laminated with an intermediate layer of resiliently compressible and elastic material, an inside fastening layer on the inside surface of the pad, and an outside fastening layer on the outside surface of the pad, said fastening layers being covered with one of a hook-type fastener or a loop-type fastener, wherein there are outer layers of the other of a hook-type fastener or a loop-type fastener on the inside and outside surfaces of the strip, and wherein the overlying portions of the pad and strip are attached by the interengagement off the hook-type and loop-type fasteners.

10. The device of claim 7, wherein the pad flexed into said tubular configuration provides front and rear portions, wherein the fastening strip is at the rear portion of the pad, wherein the outside surface of the pad at the front portion thereof provides an outwardly facing display panel, and wherein there is indicia on the display panel.

11. In combination, an article of manufacture such as a hat strap, a handle, a collar, or the like, having a part that normally comes in contact with a part of the body of the user of the article;

a relatively thin, laminated, flexible, resiliently compressible, elastic, rectangular cushioning pad having opposite longitudinal edges and opposite transverse edges, the pad including a resiliently compressible elastic intermediate layer having opposite surfaces, the pad also including first and second outer layers each having inner and outer surfaces with the inner surfaces of the outer layers being respectively adhesively bonded in congruent relation to the opposite surfaces of the intermediate layer whereby the intermediate layer is thereby sandwiched between the outer layers, the outer surfaces of the outer layers being provided with fastening loops, a relatively thin, non-elastic, rectangular fastening strip having no appreciable compressibility and being flexible but less so than the pad thereby having a measure of stiffness relative to the pad, the fastening strip having opposite longitudinal edges and opposite transverse edges, the longitudinal edges of the strip being substantially the same length as the transverse edges of the pad and the transverse edges of the strip being shorter than the longitudinal edges of the pad, the strip having opposite first and second outer surfaces, the outer surfaces of the strip being provided with fastening hooks, the fastening strip overlying the pad with a longitudinal edge of the strip lying along a longitudinal edge of the pad and the fastening hooks on the first surface of the strip overlying and releasably attached to fastening loops on the outer surface of one of the outer layers of the pad, the pad being flexed into a closed tubular configuration in tightly fitted relation about said part of the article with the second surface of the strip overlaying and releasably attached to the outer surface of the other outer layer of the pad.

12. The combination of claim 11, wherein the pad flexed into said tubular configuration provides front and rear portions, wherein the fastening strip is at the rear portion of the pad, wherein the outside surface of the outer layer of the pad at the front portion thereof provides an outwardly facing display panel, and wherein there is indicia on the display panel.

13. A strap wrap for a cap that has an adjustable strap at the back of the cap, said strap having length dimension, width and thickness dimensions, comprising:

a laminated, rectangular flexible resiliently compressible, elastic pad having opposite inside and outside surfaces, opposite longitudinal edges, opposite transverse edges, a thickness dimension measured between said surfaces and greater than the thickness of the hat strap, and length and width dimensions measured across the surfaces of the pad and between its edges, the length dimension being no greater than the length of the hat strap and the width dimension being more than twice the width of the hat strap, such dimensional relationships existing when the pad is not compressed or stretched, the pad including an intermediate layer of resiliently compressible, elastic sheet material having resilient compressibility in its thickness dimension and elasticity in its length and width dimensions and outer layers of fabric adhesively bonded to and sandwiching the intermediate layer therebetween and having outwardly directed fastening loops thereon, said inner and outer surfaces of the pad thereby having said loops thereon; and a rectangular fastening strip of fabric material that is flexible but stiffer than the pad, the strip having first and second surfaces, opposite edges, a thickness dimension measured between said surfaces, and length and width dimensions measured across the surfaces of the strip, the length of the strip being about the same as the length of the pad, the width of the strip being less than the width of the pad and about the same as the width of the hat strap, and the thickness of the strip being about equal to the thickness of the pad, the strip being relatively non-compressible and non-elastic, the fastening strip having outwardly directed fastening hooks on its first and second surfaces, the fastening strip being positioned along and in alignment with one of the longitudinal edges of the pad with the fastening hooks on the second surface of the strip overlying and releasably attached to the fastening loops on the outside surface of the pad, the fastening strip extending transversely of the pad from said one longitudinal edge of the pad, the pad being flexed into an oblong tubular configuration thereby providing an axial opening for receiving the hat strap and being stretched along its width dimension so as to wrap around the hat strap with the fastening loops on the inside surface of the pad overlaying and releasably attached to the fastening hooks on the first surface of the strip whereby the fastening strip is adapted to extend substantially the full width of the hat strap and along the length thereof.

14. The strap wrap of claim 13, wherein the pad flexed into said tubular configuration provides a front and rear portions, wherein the fastening strip is at the rear portion of the pad, wherein the outside surface of the pad at the front portion thereof provides an outwardly facing display panel, and wherein there is indicia on the display panel.

15. A wrapping device for wrapping a part of an article that normally comes in contact with a part of the body of the user of the, comprising:

a laminated, rectangular flexible pad having opposite inside and outside surfaces, opposite longitudinal edges, opposite transverse edges, a thickness dimension measured between said surfaces, and length and width dimensions measured across the surfaces of the pad and between its edges, the pad including an intermediate layer of resiliently compressible, elastic sheet material having resilient compressibility in its thickness dimension and elasticity in its length and width dimensions and outer layers of fabric adhesively bonded to and sandwiching the intermediate layer therebetween and having outwardly directed fastening loops or hooks thereon, said inner and outer surfaces of the pad thereby having said loops or hooks thereon; and a rectangular fastening strip of fabric material that is flexible but stiffer than the pad, the strip having first and second surfaces, opposite edges, a thickness dimension measured between said surfaces, and length and width dimensions measured across the surfaces of the strip, the length of the strip being about the same as the length of the pad, the width of the strip being less than the width of the pad, and the thickness of the strip being about equal to the thickness of the pad, the strip being relatively non-compressible and non-elastic, the fastening strip having outwardly directed fastening hooks or loops on its first and second surfaces, the fastening strip being positioned along and in alignment with one of the longitudinal edges of the pad with the fastening hooks or loops on the second surface of the strip overlying and releasably attached to the fastening loops or hooks on the outside surface of the pad, the fastening strip extending transversely of the pad from said one longitudinal edge of the pad, the pad being flexed into a tubular configuration thereby providing an axial opening for receiving the part being wrapped and being stretched along its width dimension so as to wrap around said part with the fastening loops or hooks on the inside surface of the pad overlaying and releasably attached to the fastening hooks or loops on the first surface of the strip whereby the fastening strip is adapted to extend along the length of the part being wrapped and transversely thereof.

16. The wrapping device of claim 15, wherein the intermediate layer is of a rubber material.

17. The wrapping device of claim 15 in combination with:

an article of manufacture having a handle; and wherein the handle is positioned in said axial opening and the pad stretched around the handle.

18. The combination of claim 16:

wherein the part being wrapped has opposite upwardly and downwardly facing portions, the lower portion normally being engaged by the user's hand for lifting the article; and wherein the fastening strip is adjacent to the downwardly facing portion of the part being wrapped on the opposite side thereof from the upwardly facing portion.

19. The wrapping device of claim 15 in combination with:

an article of manufacture having a collar and constituting the part being wrapped; and wherein the collar is positioned in said axial opening with the pad stretched around the collar.

20. A method for wrapping a part of an article that normally comes in contact with a part of the body of the user of the article so as to enhance the comfort of the article relative to the user's body, comprising the steps of:

providing a relatively thin, laminated sheet having an intermediate layer of resiliently compressible and elastic material and outer layers of fabric providing outwardly facing loop- or hook-type fasteners;

cutting a pad from the sheet of a length a width that will allow the pad to be wrapped approximately one time around the part of the article to be wrapped, the pad thereby having opposite first and second end edges;

providing an elongated, relatively narrow length of fabric providing outwardly facing hook- or loop-type fasteners, the length of fabric having a width about the same as the width of the pad, the fasteners on the strip being of the hook-type if the fasteners on the sheet are loop-type and vice versa;

cutting off a strip from the length of fabric that is approximately the same length as the length of the pad, the strip having first and second side edges;

overlaying the strip along the first end edge of the pad with the hook- and loop-type fasteners releasably fastening the strip to the pad; and flexing the pad into a tubular shape around the part being wrapped with the strip facing outwardly, with the second end edge overlaying the strip, and with the hook- and loop-type fasteners releasably fastening the pad to the strip.

21. The method of claim 20, including the further steps of:

overlaying the strip along the first end edge of the pad so that the second side edge of the strip projects endwardly from the end edge of the pad; and stretching the pad around the part while flexing it into said tubular shape and bringing the second end edge of the pad into substantially aligned overlying relation with the first side edge of the strip.

22. A method for wrapping a part of an article that normally comes in contact with a part of the body of the user of the article so as to enhance the comfort of the article relative to the user's body, the method involving the use of interengaging first and second types of fasteners wherein the first type is either a loop or hook type fastener and the second type is opposite of the first type, comprising the steps of:

providing a relatively thin, resiliently compressible and elastic pad having opposite first and second outer surfaces and opposite first and second end edges with fasteners of the hook type on the first outer surface only along the first end edge thereof and with fasteners of the loop type on the second outer surface and on that part of the first outer surface not occupied by the hook type fasteners; and flexing the pad into a tube and wrapping it tightly around said part of the article with the second outer surface overlaying the first outer surface with its loop fasteners covering and releasably attached to the hook fasteners along the first end edge wherein, except for the first end edge, the tube has a circumferential outer surface composed substantially entirely of the loop type fasteners of the first outer surface.

23. The method of claim 22, wherein the tube has a predetermined length and width, including the additional steps of:

providing a relatively thin fastening strip that is relatively stiff compared with the pad, that has a length substantially the same as said predetermined length, that has a width that is no greater than said predetermined width, that has opposite outer surfaces, and that has hook type fasteners along one of its outer surfaces;

fastening the other outer surface of the strip to the first outer surface of the pad only along the first end edge with the hook type fasteners on the strip outwardly disposed; and wherein the flexing step involves tightly wrapping the part to be wrapped within the pad with the second outer surface of the pad against the part and with the second outer surface of the pad along the second end edge in overlying releasable engagement with the outwardly disposed hook type fasteners of the strip.

24. A wrapping device, comprising:

a relatively thin, resiliently compressible and elastic pad having opposite first and second outer surfaces and opposite first and second end edges with fasteners of the hook type on the first outer surface only along the first end edge thereof and with fasteners of the loop type on the second outer surface and on that part of the first outer surface not occupied by the hook type fasteners, the pad being formed into a tube having a predetermined length and width; and a relatively thin fastening strip that is relatively stiff compared with the pad, that has a length substantially the same as said predetermined length, that has a width that is no greater than said predetermined width, that has opposite outer surfaces, and that has hook type fasteners along one of its outer surfaces, the other outer surface of the strip being fastened to the first outer surface of the pad only along the first end edge with the hook type fasteners on the strip outwardly disposed, the second outer surface of the pad along the second end edge being in overlying releasable engagement with the outwardly disposed hook type fasteners of the strip, the strip being substantially covered within the tube.

25. A wrap for wrapping a part of an article, comprising:

a flexible pad having opposite inside and outside surfaces, opposite edges, a thickness dimension measured between said surfaces, and surface dimensions measured across the surfaces of the pad and between its edges, the pad having resilient compressibility in its thickness dimension and elasticity in its surface dimensions, the outside surface being comfortable to the user when in contact with the user's body, the pad being flexed into a tubular configuration thereby providing an axial opening for receiving the part being wrapped and being stretched along one of its surface dimensions so as to wrap around the part being wrapped, the inside surface of the pad overlaying and releasably attached to the outside surface of the pad, and a stiffening member interposed the overlying surfaces of the pad.

26. A wrapping device, comprising:

a relatively thin, resiliently compressible and elastic pad having opposite first and second outer sides and opposite first and second ends terminating in respective end edges;

a stiffened, relatively inelastic portion attached to the pad along the first end edge thereof that is flexible but stiffer than the pad; and releasably attachable first and second fasteners, one of which is of the hook-type and the other of which is of the loop-type, there being first fasteners on the first outer side of the pad along the first end edge and second fasteners on the second outer side of the pad along the second end edge, the pad being formable into a tube with the first and second ends overlapping, with the second fasteners fastened to the first fasteners, and with the stiffened portion between the overlapping ends.

27. The wrapping device of claim 26, wherein the stiffened portion is releasably fastened to the pad.

28. The wrapping device of claim 26, wherein the pad has side edges extending between the end edges; and wherein the stiffened portion extends along the first end edge from one side edge to the other side edge.

29. The wrapping device of claim 26, wherein the stiffened portion has a length and a width; and wherein the tube has a diameter and a length substantially equal to the length and width of the stiffened portion.

30. A wrap for conditioning the interface between a part of an article and a user's body, comprising:

a flexible, resiliently compressible, elastic pad having opposite end segments and inside and outside surfaces and being flexed into a tubular configuration for tightly wrapping around the part being wrapped, the inside surface of the end segment at one end of the pad overlapping the outside surface of the end segment at the other end of the pad;

a flexible, relatively inelastic fastening strip that is stiffer than the pad, the strip being interposed the overlapping end segments of the pad, attached to one of the end segments, and having an outer surface facing the other end segment; and attaching members on said other end segment and the outer surface of the strip releasably attached to each other.

31. The wrap of claim 30, wherein the strip is releasably attached to the pad.

32. A wrap for conditioning the interface between a part of an article and a user's body, comprising:

a flexible, resiliently compressible, elastic pad having opposite end segments and inside and outside surfaces and being flexible into a tubular configuration for tightly wrapping around the part being wrapped, whereby the inside surface of the end segment at one end of the pad overlaps the outside surface of the end segment at the other end of the pad;

a fastening strip attached to one of the end segments, and having an outer surface facing the other end segment; and attaching members on said other end segment and the outer surface of the strip releasably attached to each other.

33. A wrapping device, comprising:

a relatively thin, resiliently compressible and elastic pad having opposite first and second outer surfaces and opposite first and second end edges with fasteners of the hook type on the first outer surface along the first end edge thereof and with fasteners of the loop type on the second outer surface and on that part of the first outer surface not occupied by the hook type fasteners, the pad being formed into a tube having a predetermined length and width; and a relatively thin fastening strip that is relatively stiff and inelastic compared with the pad, that has a length substantially the same as said predetermined length, that has a width that is no greater than said predetermined width, that has an outer surface, and that has hook type fasteners along its outer surface, the strip being fastened to the pad along the first end edge with the hook type fasteners on the strip outwardly disposed, the second outer surface of the pad along the second end edge being in overlying releasable engagement with the outwardly disposed hook type fasteners of the strip, the strip being substantially covered within the tube.

* * * * *